US010468168B2

(12) United States Patent
Nagata et al.

(10) Patent No.: US 10,468,168 B2
(45) **Date of Patent: *Nov. 5, 2019**

(54) RARE-EARTH MAGNET COMPRISING HOLMIUM AND TUNGSTEN

(71) Applicants: XIAMEN TUNGSTEN CO., LTD., Fujian (CN); Fujian Changting Golden Dragon Rare-Earth Co., Ltd., Fujian Province (CN)

(72) Inventors: Hiroshi Nagata, Fujian (CN); Jianhong Zhang, Fujian (CN)

(73) Assignees: XIAMEN TUNGSTEN CO., LTD., Fujian (CN); FUJIAN CHANGTING GOLDEN DRAGON RARE-EARTH CO., LTD, Changting, Fujian (CN)

( * ) Notice: Subject to any disclaimer, the term of this patent is extended or adjusted under 35 U.S.C. 154(b) by 16 days.

This patent is subject to a terminal disclaimer.

(21) Appl. No.: 15/562,711

(22) PCT Filed: Apr. 4, 2016

(86) PCT No.: PCT/CN2016/078412

§ 371 (c)(1),
(2) Date: Sep. 28, 2017

(87) PCT Pub. No.: WO2016/155674

PCT Pub. Date: Oct. 6, 2016

(65) Prior Publication Data

US 2018/0061538 A1 Mar. 1, 2018

(30) Foreign Application Priority Data

Apr. 2, 2015 (CN) ..... 2015 1 0153000

(51) Int. Cl.
*H01F 1/057* (2006.01)
*B22F 3/16* (2006.01)
(Continued)

(52) U.S. Cl.
CPC ..... *H01F 1/0577* (2013.01); *B22F 3/16* (2013.01); *B22F 9/04* (2013.01); *C22C 38/005* (2013.01);
(Continued)

(58) Field of Classification Search
CPC .. H01F 1/0577; B22F 3/16; B22F 9/04; B22F 2009/044; B22F 2201/013; B22F 2201/10;
(Continued)

(56) References Cited

U.S. PATENT DOCUMENTS 5,223,047 A 6/1993 Endoh et al.
2007/0125452 A1* 6/2007 Hirota ..... H01F 1/0577 148/302
(Continued)

FOREIGN PATENT DOCUMENTS

CN 1934283 A 3/2007
CN 102903471 A * 1/2013
(Continued)

OTHER PUBLICATIONS

EP Search Report cited in EP Application No. 16771429.4 dated Jun. 1, 2018, 8 pgs.
(Continued)

*Primary Examiner* — Keith Walker
*Assistant Examiner* — John A Hevey
(74) *Attorney, Agent, or Firm* — Cooper Legal Group, LLC

(57) ABSTRACT

Disclosed is a Ho and W-containing rare-earth magnet. The rare-earth magnet comprises a $R_2Fe_{14}B$ type principal phase, and comprises the following raw material components: R: 28 wt % to 33 wt %, wherein R is a raw-earth element comprising Nd and Ho, and the content of Ho is 0.3 wt % to 5 wt %; B: 0.8 wt % to 1.3 wt %; W: 0.005 wt %
(Continued)

to 0.3 wt %, and the balance of T and inevitable purities, wherein T is an element mainly comprising Fe and/or Co. The rare-earth magnet mainly consists of a W-rich grain boundary phase and a Ho-rich principal phase; crystal grain growth of the Ho-containing magnet in a sintering process is constrained by the trace of W, thereby preventing AGG from occurring on the Ho-containing magnet, and obtaining a magnet with high coercivity and high heat resistance.

20 Claims, 1 Drawing Sheet

(51) Int. Cl.

| | |
|---|---|
| ***B22F 9/04*** | (2006.01) |
| ***C22C 38/00*** | (2006.01) |
| ***C22C 38/06*** | (2006.01) |
| ***C22C 38/12*** | (2006.01) |
| ***C22C 38/16*** | (2006.01) |

(52) U.S. Cl.
CPC ..... *C22C 38/06* (2013.01); *C22C 38/12* (2013.01); *C22C 38/16* (2013.01); *B22F 2009/044* (2013.01); *B22F 2201/013* (2013.01); *B22F 2201/10* (2013.01); *B22F 2201/20* (2013.01); *B22F 2202/05* (2013.01); *B22F 2301/355* (2013.01); *C22C 2202/02* (2013.01)

(58) Field of Classification Search
CPC ..... B22F 2201/20; B22F 2301/355; B22F 2202/05; C22C 38/005; C22C 38/06; C22C 38/12; C22C 38/16; C22C 2202/02
See application file for complete search history.

(56) References Cited

U.S. PATENT DOCUMENTS

| | | | | |
|---|---|---|---|---|
| 2007/0157998 | A1* | 7/2007 | Hirota | C22C 1/0441 148/302 |
| 2009/0035170 | A1* | 2/2009 | Nakajima | B22D 11/0611 420/83 |
| 2011/0095855 | A1* | 4/2011 | Kuniyoshi | H01F 1/0577 335/302 |
| 2012/0091844 | A1* | 4/2012 | Nakajima | C22C 38/005 310/152 |
| 2016/0300648 | A1* | 10/2016 | Nagata | H01F 1/057 |

FOREIGN PATENT DOCUMENTS

| | | | | |
|---|---|---|---|---|
| CN | 102903471 | A | 1/2013 | |
| CN | 103426578 | A | 12/2013 | |
| EP | 1961506 | A1 | 8/2008 | |
| JP | 2008223052 | A | 9/2008 | |
| WO | WO-2012102497 | A2 * | 8/2012 | C22C 38/002 |

OTHER PUBLICATIONS

International Search Report in international application No. PCT/CN2016/078412 dated Jul. 12, 2016 5 pgs.

Yan, et al., "Magnetic and microstructural properties of sintered FeNdB-based magnets with W, Mo and Nb additions", Journal of Alloys and Compounds 257 (1997) 2'73-277, pp. 1-5

* cited by examiner

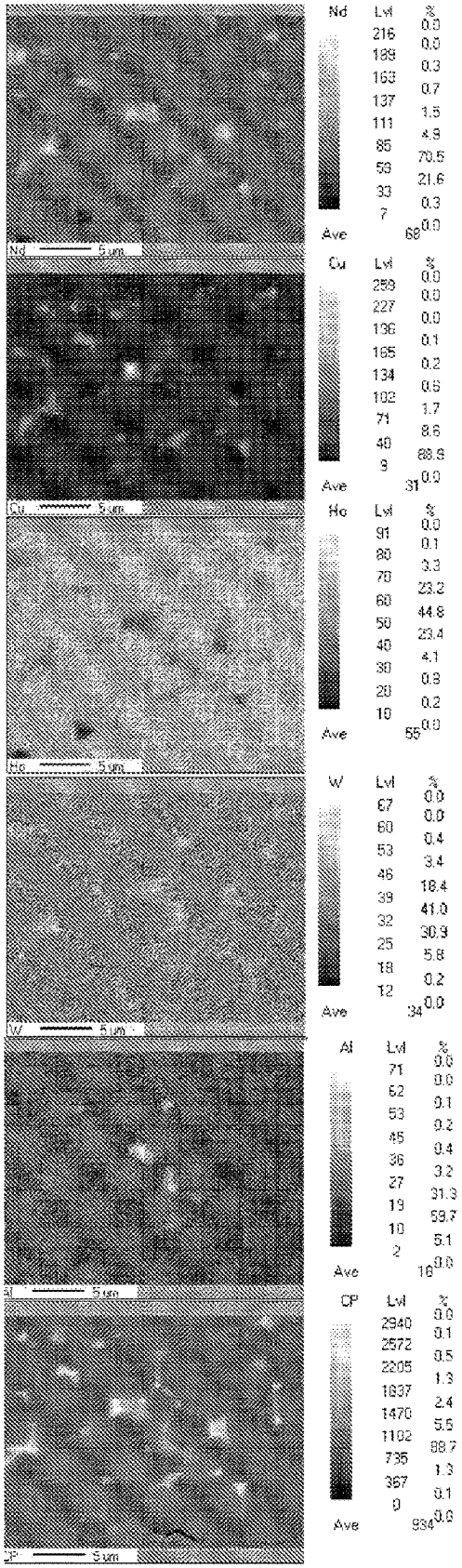
Nd
Lvl
%
216 0.0
189 0.0
163 0.3
137 0.7
111 1.5
85 4.9
59 70.5
33 21.6
7 0.3
Ave 68 0.0
Nd 5 µm
Cu
Lvl
%
259 0.0
227 0.0
196 0.0
165 0.1
134 0.2
102 0.6
71 1.7
40 8.6
9 88.9
Ave 31 0.0
Cu 5 µm
Ho
Lvl
%
91 0.0
80 0.1
70 3.3
60 23.2
50 44.8
40 23.4
30 4.1
20 0.8
10 0.2
Ave 55 0.0
Ho 5 µm
W
Lvl
%
67 0.0
60 0.0
53 0.4
46 3.4
39 18.4
32 41.0
25 30.9
18 5.8
12 0.2
Ave 34 0.0
W 5 µm
Al
Lvl
%
71 0.0
62 0.0
53 0.1
45 0.2
36 0.4
27 3.2
19 31.3
10 59.7
2 5.1
Ave 16 0.0
Al 5 µm
CP
Lvl
%
2940 0.0
2572 0.1
2205 0.5
1837 1.3
1470 2.4
1102 5.5
735 88.7
367 1.3
0 0.1
Ave 934 0.0
CP 5 µm

RARE-EARTH MAGNET COMPRISING HOLMIUM AND TUNGSTEN

TECHNICAL FIELD

The present disclosure relates to the technical field of magnet manufacturing, and particularly to a Ho and W-containing rare-earth magnet.

BACKGROUND

A sintered Nd—Fe—B magnet has superior magnetic capabilities, and therefore has been widely applied in the fields of wind power generation, nuclear magnetic resonance, automobiles, computers, aerospace, household appliances and others, resulting in too much consumption of the main raw material Nd of the sintered Nd—Fe—B magnet. Since there is a large amount of Ho, Ho is selected to partially replace the metallic Nd in the magnet, which has great significance for comprehensive utilization of rare-earth resources. Also, since coercivity and temperature stability of the Nd—Fe—B magnet can be significantly improved with Ho, when the low-cost Ho, which is easily acquired in industrial production, is selected to partially replace the metallic Nd in the magnet, comprehensive production cost of the rare-earth magnet with high capabilities can be reduced.

It is described in "Effects of Adding Gd or Ho on Structure and Performance of Sintered Nd—Fe—B Magnet" (Powder Metallurgy Industry, Volume 21 Issue 5, October, 2011) written by L I Feng et al., that by adding Ho, the temperature stability of a material can be significantly improved, the intrinsic coercivity of the material is greatly improved, the remanence is reduced, the squareness of a J-H demagnetization curve is significantly improved, and crystal grains of the magnet are refined to a certain extent, allowing uniform distribution of a Nd-rich phase, and reduction in defects such as a cavities, making the magnet more compact.

It is described in "Effects of Adding Ho on Magnetic Performance and Temperature Stability of Sintered Nd—Fe—B Permanent Magnet Material" (Magnetic Material and Device, August, 2011) written by LIU Xianglian that by adding a suitable amount of Ho, formation of an a-Fe phase in a Nd—Fe—B alloy ingot is inhibited, and growth of $Nd_2Fe_{14}B$ columnar crystals is promoted, allowing uniform distribution of a Nd-rich phase, and allowing the sintered Nd—Fe—B magnet to have a high degree of densification and a good microstructure; in addition, the intrinsic coercivity and the temperature stability of the magnet can be improved by adding a certain amount of Ho. Similar contents are described in "Effects of Adding Gd and Ho on Structure and Performance of Sintered Nd—Fe—B magnet" (Rare Earth, Volume 34 Issue 1, February 2013) written by ZHANG Shimao et al.

Based on the above, it can be concluded that, by adding Ho into the magnet, crystal grains of the magnet can be refined, allowing uniform distribution of a Nd-rich phase and improving the sintering capabilities of the magnet.

On the other hand, the method for manufacturing a Nd—Fe—B sintered magnet has been gradually improved. For example, a strip casting process (SC process) has been popularized in China since 2005, and the sintered magnet went into mass production with such a process in 2010. After raw materials are dissolved and casted with the SC process, it is easy to manufacture a thin-plate alloy, the crystallization structure in the thin-plate alloy is relatively uniform and fine, and the Nd-rich phase is distributed uniformly in micrometers. If the SC process is combined with a hydrogen decrepitation process, fine powder having an average grain size less than or equal to 10 μm can be obtained, and also, the sintering capabilities of the magnet can be significantly improved.

However, for the rare-earth magnet with a sharp improvement in sintering capabilities, if the inhibition of abnormal grain growth only relies on a small amount of impurities present in a grain boundary, the abnormal grain growth (AGG) would occur very easily.

SUMMARY

An objective of the present disclosure is to provide a Ho and W-containing rare-earth magnet so as to overcome the defects in the conventional technology. In the rare-earth magnet, the grain growth of a Ho-containing magnet during a sintering process is inhibited by a trace amount of W, thereby preventing AGG from occurring in the Ho-containing magnet, and obtaining a magnet with high coercivity and high heat resistance.

A technical solution as follows is provided in the present disclosure.

A Ho and W-containing rare-earth magnet is provided, which comprises a main phase of $R_2Fe_{14}B$ main phase, and comprises raw material components as follows:

R: 28 wt % to 33 wt %, where R is a rare-earth element comprising Nd and Ho, and the content of Ho ranges from 0.3 wt % to 5 wt %;

B: 0.8 wt % to 1.3 wt %;

W: 0.0005 wt % to 0.03 wt %, and the balance being T and inevitable impurities, where T mainly comprises Fe and 0 wt % to 18 wt % of Co.

The rare-earth element in the present disclosure includes an element Y.

With the element Ho, a Nd-rich phase of the rare-earth magnet is distributed uniformly, thereby improving sintering performances of the magnet. However, an abnormal grain growth (AGG) occurs very easily in the rare-earth magnet with significantly improved sintering performances. Therefore, a trace amount of W is used to inhibit the abnormal grain growth (AGG) in the present disclosure. Since W is different from the rare-earth elements, iron and boron as main constituent elements in ionic radius and electronic structure, there is almost no W contained in the $R_2Fe_{14}B$ main phase, the trace amount of W precipitates under a Pinning effect as the $R_2Fe_{14}B$ main phase precipitates during a cooling process of a melt, and pins the migration of the grain boundary, thereby preventing AGG from occurring in the Ho-containing magnet in the sintering process, and obtaining a magnet with high coercivity and high heat resistance.

In addition, W, as a rigid element, can strengthen a flexible grain boundary, thereby having a lubrication function and achieving an effect of improving the degree of orientation as well.

In an existing method for manufacturing a rare-earth magnet, an electrolytic cell is used, in which, a cylindrical graphite crucible serves as an anode, a tungsten (W) rod configured in an axial line of the graphite crucible serves as a cathode, and a rare-earth metal is collected by a tungsten crucible at the bottom of the graphite crucible. During the above process of manufacturing the rare-earth element (for example Nd), a small amount of W would be inevitably mixed therein. In practice, another metal such as molybdenum (Mo) with a high melting point may also serve as the cathode, and by collecting a rare-earth metal using a molybdenum crucible, a rare-earth element which comprises no W is obtained.

Therefore, in the present disclosure, W may be an impurity of a metal raw material (such as, a pure iron, a rare-earth metal or B), and the raw material used in the present disclosure is selected based on the content of the impurity in the raw material. In practice, a raw material which does not comprise W may also be selected, and a metal raw material W is added as described in the present disclosure. Briefly, as long as the raw material of the rare-earth magnet contains the necessary amount of W, it is of no matter where W comes from. Table 1 shows the content of the element W in metal Nd from different production areas and different workshops by example.

TABLE 1

Content of Element W in Metal Nd from Different Production Areas and Different Workshops

| Metal Nd Raw material | Purity | W Concentration (ppm) |
|---|---|---|
| A | 2N5 | 0 |
| B | 2N5 | 1 |
| C | 2N5 | 11 |
| D | 2N5 | 28 |
| E | 2N5 | 89 |
| F | 2N5 | 150 |
| G | 2N5 | 251 |

2N5 in Table 1 represents 99.5%.

It should be illustrated that, the content ranges from 28 wt % to 33 wt % for R and from 0.8 wt % to 1.3 wt % for B in the present disclosure belong to the conventional selections in the industry. Therefore, the content ranges of R and B are not tested and verified in the examples.

In a recommended embodiment, T comprises at least one element with a content less than or equal to 2.0 wt % selected from Sn, Sb, Hf, Bi, V, Zr, Mo, Zn, Ga, Nb, Ni, Ti, Cr, Si, Mn, S, or P; Cu with a content less than or equal to 0.8 wt %; Al with a content less than or equal to 0.8 wt %; and the balance being Fe.

In a recommended embodiment, the rare-earth magnet is manufactured by: a step of preparing an alloy for a rare-earth magnet from a melt of raw material components of the rare-earth magnet, where the alloy for the rare-earth magnet is obtained by cooling the melt of a raw material alloy at a cooling speed greater than or equal to $10^{2\circ}$ C./s and less than or equal to $10^{4\circ}$ C./s with a strip casting process; a step of performing coarse grinding on the alloy for rare-earth magnet, and then performing fine grinding to manufacture fine powder; and a step of subjecting the fine powder to a magnetic field shaping process to obtain a shaped body, and sintering the shaped body in a vacuum or an inert gas, to obtain a sintered rare-earth magnet with an oxygen content less than or equal to 1000 ppm.

In addition, in the present disclosure, all steps of manufacturing the magnet are performed in a low oxygen environment, and the O content is controlled within a low level. In general, generation of AGG can be reduced in a rare-earth magnet with a high oxygen content (greater than or equal to 1000 ppm), and the rare-earth magnet with a low oxygen content (less than or equal to 1000 ppm) has good magnetic properties, in which however AGG occurs easily. In the present disclosure, by adding a trace amount of W, an effect of reducing AGG can also be realized in the magnet with a low oxygen content.

It should be illustrated that the steps of manufacturing the magnet in the low oxygen environment belong to the conventional technology, and all examples of the present disclosure are implemented with the steps of manufacturing the magnet in the low oxygen environment, which are not described in detail here anymore.

In a recommended embodiment, the alloy for the rare-earth magnet is obtained by cooling the melt of the raw material alloy at a cooling speed greater than or equal to $10^{2\circ}$ C./s and less than or equal to $10^{4\circ}$ C./s with a strip casting process, the coarse grinding is a step of performing hydrogen decrepitation on the alloy for the rare-earth magnet to obtain coarse powder, and the fine grinding is a step of performing jet milling on the coarse powder.

In a case where the powder is obtained by combined processing with the strip casting process (SC process) and the hydrogen decrepitation process, the dispersion performance of the Nd-rich phase is further improved, and the presence of W also prevents the occurring of AGG during the sintering process of Ho-containing powder manufactured in the steps above, obtaining a magnet with good sintering performances, high coercivity (Hcj), high squareness (SQ) and high heat resistance.

In a recommended embodiment, the rare-earth magnet is a Nd—Fe—B based sintered magnet.

In a recommended embodiment, a grain boundary of the rare-earth magnet comprises a W-rich region in which the content of W is greater than or equal to 40 ppm and less than or equal to 3000 ppm, and the W-rich region occupies at least 50% by volume of the grain boundary. The trace amount of W precipitates under the pinning effect as the $R_2Fe_{14}B$ main phase precipitates in the cooling process of the melt, and concentrates in the grain boundary, thereby sufficiently playing its role.

In a recommended embodiment, T comprises Cu with a content ranging from 0.1 wt % to 0.8 wt %, and the Cu distributed in the grain boundary increases a liquid phase with a low melting point, and the increase of the liquid phase with the low melting point can improve the distribution of W. In the present disclosure, W is distributed rather uniformly in the grain boundary, has a distribution scope greater than the distribution scope of the Nd-rich phase, and substantially covers a whole scope of the Nd-rich phase, which may be regarded as the evidence that W exhibits the pinning effect and prevents the growth of the crystal grains. AGG can be further reduced in the Ho-containing magnet in the sintering process after a suitable amount of Cu is added.

In a recommended embodiment, T further comprises Al with a content ranging from 0.1 wt % to 0.8 wt %. The addition of Al refines the crystal grains of the alloy, and also reduces the volume of each region of the Nd-rich phase and the B-rich phase. Apart of Al enters into the Nd-rich phase and functions together with Cu, such that the wetting angle between the Nd-rich phase and the main phase is improved, and the Nd-rich phase and W are distributed very uniformly along the boundary, reducing the AGG occurring.

In a recommended embodiment, T further comprises at least one element selected from Sn, Sb, Hf, Bi, V, Zr, Mo, Zn, Ga, Nb, Ni, Ti, Cr, Si, Mn, S, or P, the total content of the above elements is 0.1 wt % to 2.0 wt % of the components of the rare-earth magnet.

In a recommended embodiment, the rare-earth magnet consists of at least two phases containing a W-rich grain boundary phase and a Ho-rich main phase.

All numerical ranges referred to in the present disclosure include all point values in the ranges.

Compared with the conventional technology, the present disclosure has features as follows.

1) Since W is different from the rare-earth elements, iron and boron as main constituent elements in ionic radius and electronic structure, there is almost no W contained in the $R_2Fe_{14}B$ main phase, and W precipitates under a pinning effect into the grain boundary during a cooling process of the melt as the $R_2Fe_{14}B$ main phase precipitates, to form a W-rich phase, thereby preventing AGG from occurring.

Moreover, since Ho and W has a relationship therebetween like the relationship between water and oil, which is mutually exclusive and cannot coexist, the Ho-rich phase enters into the main phase, to form $Ho_2Fe_{14}B$ (the intensity of the anisotropic fields for $R_2Fe_{14}B$ is described as follows: Gd<Nd<Pr≤Ho<Dy≤Tb), from which it can be seen that, the formation of $Ho_2Fe_{14}B$ can increase the anisotropic field of the magnet. Therefore, the coercivity and the anisotropic field of the magnet are improved significantly under a combined action of the W-rich grain boundary phase and the Ho-rich main phase.

2) W, as a rigid element, can strengthen a flexible grain boundary phase, thereby functioning as a lubricant and improving the degree of orientation.

3) In the embodiments in which Al and Cu are added, the Nd-rich phase and W are distributed very uniformly along the boundary, thereby reducing the AGG occurring.

4) Since there is a large amount of Ho, and Ho is a relatively cheap material which can be acquired in industry production, Ho is selected to partially replace metallic Nd in the magnet in the present disclosure, thereby having characteristics of a high comprehensive economic effect and a high industrial value.

BRIEF DESCRIPTION OF THE DRAWINGS

FIG. 1 shows EPMA detection results for a sintered magnet in example 2 in EXAMPLE I.

DETAILED DESCRIPTION OF THE EMBODIMENTS

The present disclosure is further described in detail in conjunction with examples hereinafter.

Sintered magnets obtained in EXAMPLEs I to IV were detected in a detection manner as follows.

Evaluation on magnetic performance: The magnetic performances of a sintered magnet were detected using a NIM-10000H-type BH bulk rare-earth permanent-magnet nondestructive measurement system from National Institutes of Metrology in China.

Determination on attenuation ratio of magnetic flux: The sintered magnet was placed in an environment of 180° C. for 30 minutes, then naturally cooled to room temperature, and then measured for its magnetic flux. The measured magnetic flux was compared with the measured data prior to heating, to calculate an attenuation ratio of the measured magnetic flux after heating relative to the measured magnetic flux prior to heating.

Determination on AGG: The sintered magnet was polished in a horizontal direction, and an average number of AGGs per 1 $cm^2$ was obtained, where AGG in the present disclosure refers to a grain with a grain size greater than 40 μm.

Example I

Preparation process of raw material: Nd with a purity of 99.5%, Ho with a purity of 99.9%, industrial Fe—B, industrial pure Fe, Cu and Al with purities of 99.5%, and W with a purity of 99.99% were prepared, which were formulated in weight percentage wt %.

The content of each of the elements is shown in Table 2.

TABLE 2

| Composition proportion of elements | | | | | | | |
|---|---|---|---|---|---|---|---|
| No. | Nd | Ho | B | Cu | Al | W | Fe |
| Comparative example 1 | 31.9 | 0.1 | 1.0 | 0.4 | 0.6 | 0.01 | Balance |
| Example 1 | 31.7 | 0.3 | 1.0 | 0.4 | 0.6 | 0.01 | Balance |
| Example 2 | 31 | 1 | 1.0 | 0.4 | 0.6 | 0.01 | Balance |
| Example 3 | 29 | 3 | 1.0 | 0.4 | 0.6 | 0.01 | Balance |
| Example 4 | 27 | 5 | 1.0 | 0.4 | 0.6 | 0.01 | Balance |
| Comparative example 2 | 26 | 6 | 1.0 | 0.4 | 0.6 | 0.01 | Balance |

For each of the above groups, 10 Kg of a raw material was formulated by weighing the elements respectively according to the element composition in Table 2.

Melting process: Each of the prepared raw materials was put into a crucible made of aluminum oxide, and was subjected to vacuum melting in a vacuum induction melting furnace under a vacuum of $10^{-2}$ Pa at a temperature less than or equal to 1600° C.

Casting process: After the vacuum melting, an Ar gas was introduced into the melting furnace until the pressure reached 55000 Pa, and then casting was performed using a single-roller quenching process at a cooling speed from $10^{2}$° C./s to $10^{4}$° C./s, obtaining a rapidly quenched alloy. Hydrogen decrepitation process: A hydrogen decrepitation furnace in which the rapidly quenched alloy was placed was vacuumized at room temperature, and then hydrogen with an purity of 99.5% was introduced into the hydrogen decrepitation furnace to a pressure of 0.09 Mpa. After left for 2 hours, the furnace was vacuumized while raising the temperature, which was vacuumized for 1.5 hours at a temperature of 500° C., and then was cooled down, obtaining powder after the hydrogen decrepitation.

Fine grinding process: The specimen obtained after the hydrogen decrepitation was subjected to jet milling in a pulverizing chamber at a pressure of 0.4 Mpa in an atmosphere having an oxidizing gas content less than or equal to 100 ppm, obtaining fine powder having an average grain size of 3.5 μm. The oxidizing gas refers to oxygen or moisture.

Methyl caprylate was added into the powder obtained after the jet milling in an addition amount of 0.2% relative to the weight of the mixed powder, and then was well mixed with the powder by a V-type mixer.

Magnetic field shaping process: The powder in which the methyl caprylate had been added as described above was primarily shaped as a cube having a side length of 25 mm using a right angle-oriented magnetic field shaping machine in an oriented magnetic field of 1.8 T at a shaping pressure of 0.2 ton/$cm^2$, and was demagnetized after the primary shaping.

In order to prevent the shaped body obtained after the primary shaping from being in contact with air, the shaped body was sealed, and then subjected to a secondary shaping using a secondary shaping machine (isostatic pressure shaping machine).

Sintering process: The shaped body was transferred to a sintering furnace for sintering, which was sintered under a vacuum of $10^{-3}$ Pa at a temperature of 200° C. for 2 hours and at a temperature of 900° C. for 2 hours, and then sintered at a temperature of 1050° C. for 2 hours. Thereafter, Ar gas was introduced into the sintering furnace until the pressure reached 0.1 Mpa, and then the sintered body was cooled to room temperature.

Heat treatment process: The sintered body was subjected to heat treatment in a high-purity Ar gas at a temperature of 620° C. for 1 hour, cooled to room temperature and then taken out.

Processing process: The sintered body obtained after the heat treatment was processed into a magnet with φ of 15 mm and a thickness of 5 mm, with the direction of the thickness of 5 mm being the orientation direction of the magnetic field.

Evaluation results of the magnets in examples and comparative examples are shown in Table 3.

TABLE 3

Performance Evaluation for Magnets in Examples and Comparative Examples

| No. | AGG The number of AGGs | Br (kGs) | Hcj (kOe) | SQ (%) | (BH)max (MGOe) | Attenuation ratio of magnetic flux (%) |
|---|---|---|---|---|---|---|
| Comparative example 1 | 8 | 13.4 | 12.8 | 93.6 | 42.0 | 13.8 |
| Example 1 | 0 | 13.8 | 15.8 | 96.5 | 45.9 | 2.5 |
| Example 2 | 0 | 13.6 | 16.2 | 97.0 | 44.9 | 1.9 |
| Example 3 | 0 | 13.0 | 18.2 | 97.2 | 41.1 | 1.4 |
| Example 4 | 1 | 12.5 | 19.6 | 96.8 | 37.8 | 2.0 |
| Comparative example 2 | 7 | 11.3 | 14.0 | 94.1 | 30.0 | 12.6 |

Throughout the implementation process, the O content in the magnets in the comparative examples and examples was controlled to be less than or equal to 1000 ppm.

It can be seen from the comparative examples and examples that, a large number of AGG occur in a case where the content of Ho is less than 0.3 wt %.

Whereas, in a case where the content of Ho is greater than 5 wt %, Br can be reduced, and the effect of the hydrogen decrepitation process on the rapidly quenched alloy is deteriorated, which results in a large number of abnormally large grains being generated in the jet milling process. These abnormally large grains also form AGG in the sintering process.

The sintered magnet manufactured in example 2 was subjected to Field emission electron probe microanalysis (FE-EPMA) (JEOL, 8530F) detection, and results are shown in FIG. 1, from which it can be seen that, the W-rich phase precipitates under a pinning effect into the grain boundary, thereby preventing AGG from occurring, and since Ho and W have a relationship therebetween like the relationship between water and oil, which is mutually exclusive and cannot coexist, the Ho-rich phase enters into the main phase to form $Ho_2Fe_{14}B$, and the formation of $Ho_2Fe_{14}B$ can improve the anisotropic field of the magnet. Therefore, the coercivity and the anisotropic field of the magnet are improved significantly under a combined action of the W-rich grain boundary phase and the Ho-rich main phase.

Similarly, FE-EPMA detection was performed on the sintered magnets in examples 1, 3, and 4. It can be also observed that the W-rich phase precipitates under the pinning effect into the grain boundary, and pins the migration of the grain boundary, thereby preventing AGG from occurring. Ho-rich phase entered into the main phase to form $Ho_2Fe_{14}B$, improving the anisotropic field of the magnets.

In addition, in examples 1 to 4, the grain boundary of the rare-earth magnets comprises a W-rich region in which the content of W is greater than or equal to 40 ppm and less than or equal to 3000 ppm, and the W-rich region occupies more than or equal to 50% by volume of the grain boundary.

Example II

Preparation process of raw material: Nd with a purity of 99.5%, Ho with a purity of 99.9%, industrial Fe—B, industrial pure Fe, and W with a purity of 99.99% were prepared, which were formulated in weight percentage wt %.

The content of each of the elements is shown in Table 4.

TABLE 4

Composition proportion of elements

| No. | Nd | Ho | B | W | Fe |
|---|---|---|---|---|---|
| Comparative example 1 | 31 | 1 | 0.8 | 0.0001 | Balance |
| Example 1 | 31 | 1 | 0.8 | 0.0005 | Balance |
| Example 2 | 31 | 1 | 0.8 | 0.002 | Balance |
| Example 3 | 31 | 1 | 0.8 | 0.01 | Balance |
| Example 4 | 31 | 1 | 0.8 | 0.03 | Balance |
| Comparative example 2 | 31 | 1 | 0.8 | 0.04 | Balance |

For each of the above groups, 10 Kg of a raw material was formulated by weighing the elements respectively according to the element composition in Table 4.

Melting process: Each of the prepared raw materials was put into a crucible made of aluminum oxide, and was subjected to vacuum melting in a vacuum induction melting furnace under a vacuum of $10^{-2}$ Pa at a temperature less than or equal to 1500° C.

Casting process: After the vacuum melting, an Ar gas was introduced into the melting furnace until the pressure reached 48000 Pa, and then casting was performed using a single-roller quenching process at a cooling speed ranging from $10^{2}$° C./s to $10^{4}$° C./s, obtaining a rapidly quenched alloy.

Hydrogen decrepitation process: A hydrogen decrepitation furnace in which the rapidly quenched alloy was placed was vacuumized at room temperature, and then hydrogen with an purity of 99.5% was introduced into the hydrogen decrepitation furnace to a pressure of 0.09 Mpa. After left for 2 hours, the furnace was vacuumized while raising the temperature, which was vacuumized for 2 hours at a temperature of 540° C., and then was cooled down, obtaining powder after the hydrogen decrepitation.

Fine grinding process: The specimen obtained after the hydrogen decrepitation was subjected to jet milling in a pulverizing chamber at a pressure of 0.45 Mpa in an atmosphere having an oxidizing gas content less than or equal to 100 ppm, obtaining fine powder having an average grain size of 3.6 μm. The oxidizing gas refers to oxygen or moisture.

Methyl caprylate was added into the powder obtained after the jet milling in an addition amount of 0.2% relative to the weight of the mixed powder, and then was well mixed with the powder by a V-type mixer.

Magnetic field shaping process: The powder in which the methyl caprylate had been added as described above was primarily shaped as a cube having a side length of 25 mm using a right angle-oriented magnetic field shaping machine in an oriented magnetic field of 1.8 T at a shaping pressure of 0.2 ton/cm$^2$, and was demagnetized after the primary shaping. The shaped body was taken out from the space of the magnetic field shaping machine, and another magnetic field was applied onto the shaped body, so as to subject the magnetic powder attaching on the surface of the shaped body to a second demagnetizing process.

In order to prevent the shaped body obtained after the primary shaping from being in contact with air, the shaped body was sealed, and then subjected to a secondary shaping using a secondary shaping machine (isostatic pressure shaping machine).

Sintering process: The shaped body was transferred to a sintering furnace for sintering, which was sintered under a vacuum of $10^{-3}$ Pa at a temperature of 200° C. for 2 hours and at a temperature of 700° C. for 2 hours, and then sintered at a temperature of 1050° C. for 2 hours. Thereafter, Ar gas was introduced into the sintering furnace until the pressure reached 0.1 MPa, and then the sintered body was cooled to room temperature.

Heat treatment process: The sintered body was subjected to heat treatment in a high-purity Ar gas at a temperature of 600° C. for 1 hour, cooled to room temperature and then taken out.

Processing process: The sintered body obtained after the heat treatment was processed into a magnet with φ of 15 mm and a thickness of 5 mm, with the direction of the thickness of 5 mm being the orientation direction of the magnetic field.

Evaluation results of the magnets in examples and comparative examples are shown in Table 5.

TABLE 5

Performance Evaluation for Magnets in Examples and Comparative Examples

| No. | AGG The number of AGGs | Br (kGs) | Hcj (kOe) | SQ (%) | (BH)max (MGOe) | Attenuation ratio of magnetic flux (%) |
|---|---|---|---|---|---|---|
| Comparative example 1 | 10 | 13.1 | 13.9 | 94.2 | 40.4 | 17.0 |
| Example 1 | 0 | 13.8 | 14.6 | 96.6 | 46.0 | 1.8 |
| Example 2 | 0 | 14.0 | 14.8 | 96.9 | 47.5 | 1.6 |
| Example 3 | 1 | 13.9 | 14.7 | 97.0 | 46.9 | 1.5 |
| Example 4 | 2 | 13.8 | 14.6 | 96.5 | 45.9 | 1.8 |
| Comparative example 2 | 3 | 12.8 | 10.9 | 87 | 35.6 | 7.8 |

By detection, in examples 1 to 4, the grain boundary of the rare-earth magnet comprises a W-rich region in which the content of W is greater than or equal to 40 ppm and less than or equal to 3000 ppm, and the W-rich region occupies more than or equal to 50% by volume of the grain boundary.

Throughout the implementation process, the O content in the magnets in the comparative examples and examples was controlled to be less than or equal to 1000 ppm.

It can be seen from the comparative examples and examples that, in a case where the content of W is less than 5 ppm, W is not distributed sufficiently, and there is not enough material for preventing crystal grains from growing in the grain boundary, thus generating a large number of AGGs.

Whereas, in a case where the content of W is greater than 300 ppm, a few $WB_2$ phases are generated, resulting in the reduction in Br, and the effect of the hydrogen decrepitation process on the rapidly quenched alloy is deteriorated, which results in a large number of abnormally large grains being generated in the jet milling process, and the abnormally large particles also form AGG in the sintering process.

Similarly, FE-EPMA detection was performed on the sintered magnets in examples 1, 2, 3 and 4. It can be also observed that the W-rich phase precipitates under the pinning effect into the grain boundary and pins the migration of the grain boundary, thereby preventing AGG from occurring. Ho-rich phase entered into the main phase to form $Ho_2Fe_{14}B$, improving the anisotropic field of the magnets.

Example III

Preparation process of raw material, Nd with a purity of 99.5%, Ho with a purity of 99.9%, and industrial Fe—B, industrial pure Fe, W with a purity of 99.99%, and Zr, Ga, Nb, Mn, Si, Cr, Cu and Mo with purities of 99.5% were prepared, which were formulated in weight percentage wt %.

The content of each of the elements is shown in Table 6.

TABLE 6

Composition proportion of elements

| No. | Nd | Ho | B | W | Zr | Ga | Nb | Mn | Si | Cr | Mo | Cu | Fe |
|---|---|---|---|---|---|---|---|---|---|---|---|---|---|
| Comparative example 1 | 31 | 1 | 0.85 | 0.02 | 0.8 | 0.1 | 0.2 | 0.1 | 0.1 | 0.1 | 0.5 | 0.05 | Balance |
| Example 1 | 31 | 1 | 0.85 | 0.02 | 0.8 | 0.1 | 0.2 | 0.1 | 0.1 | 0.1 | 0.5 | 0.1 | Balance |
| Example 2 | 31 | 1 | 0.85 | 0.02 | 0.8 | 0.1 | 0.2 | 0.1 | 0.1 | 0.1 | 0.5 | 0.4 | Balance |
| Example 3 | 31 | 1 | 0.85 | 0.02 | 0.8 | 0.1 | 0.2 | 0.1 | 0.1 | 0.1 | 0.5 | 0.6 | Balance |
| Example 4 | 31 | 1 | 0.85 | 0.02 | 0.8 | 0.1 | 0.2 | 0.1 | 0.1 | 0.1 | 0.5 | 0.8 | Balance |
| Comparative example 2 | 31 | 1 | 0.85 | 0.02 | 0.8 | 0.1 | 0.2 | 0.1 | 0.1 | 0.1 | 0.5 | 0.9 | Balance |

For each of the above groups, 10 Kg of a raw material was formulated by weighing the elements respectively according to the element composition in Table 6.

Melting process: Each of the prepared raw materials was put into a crucible made of aluminum oxide, and was subjected to vacuum melting in a vacuum induction melting furnace under a vacuum of $10^{-2}$ Pa at a temperature less than or equal to 1500° C.

Casting process: After the vacuum melting, an Ar gas was introduced into the melting furnace until the pressure reached 45000 Pa, and then casting was performed using a single-roller quenching process at a cooling speed ranging from $10^{2}$° C./s to $10^{4}$° C./s, obtaining a rapidly quenched alloy.

Hydrogen decrepitation process: A hydrogen decrepitation furnace in which the rapidly quenched alloy was placed was vacuumized at room temperature, and then hydrogen with an purity of 99.5% was introduced into the hydrogen decrepitation furnace to a pressure of 0.085 Mpa. After left for 2 hours, the furnace was vacuumized while raising the temperature, which was vacuumized for 2 hours at a temperature of 540° C., and then was cooled down, obtaining powder after the hydrogen decrepitation.

Fine grinding process: The specimen obtained after the hydrogen decrepitation was subjected to jet milling in a pulverizing chamber at a pressure of 0.4 Mpa in an atmosphere having an oxidizing gas content less than or equal to 100 ppm, obtaining fine powder having an average grain size of 3.2 μm. The oxidizing gas refers to oxygen or moisture.

Methyl caprylate was added into the powder obtained after the jet milling in an addition amount of 0.2% relative to the weight of the mixed powder, and then was well mixed with the powder by a V-type mixer.

Magnetic field shaping process: The powder in which the methyl caprylate had been added as described above was primarily shaped as a cube having a side length of 25 mm using a right angle-oriented magnetic field shaping machine in an oriented magnetic field of 1.8 T at a shaping pressure of 0.2 ton/cm$^2$, and was demagnetized after the primary shaping. The shaped body was taken out from the space of the magnetic field shaping machine, and another magnetic field was applied onto the shaped body, so as to subject the magnetic powder attaching on the surface of the shaped body to a second demagnetizing process.

In order to prevent the shaped body obtained after the primary shaping from being in contact with air, the shaped body was sealed, and then subjected to a secondary shaping using a secondary shaping machine (isostatic pressure shaping machine).

Sintering process: The shaped body was transferred to a sintering furnace for sintering, which was sintered under a vacuum of $10^{-3}$ Pa at a temperature of 200° C. for 2 hours and at a temperature of 700° C. for 2 hours, and then sintered at a temperature of 1040° C. for 2 hours. Thereafter, Ar gas was introduced into the sintering furnace until the pressure reached 0.1 MPa, and then the sintered body was cooled to room temperature.

Heat treatment process: The sintered body was subjected to heat treatment in a high-purity Ar gas at a temperature of 600° C. for 1 hour, cooled to room temperature and then taken out.

Processing process: The sintered body obtained after the heat treatment was processed into a magnet with φ of 15 mm and a thickness of 5 mm, with the direction of the thickness of 5 mm being the orientation direction of the magnetic field.

Evaluation results of the magnets in examples and comparative examples are shown in Table 7.

TABLE 7

Performance Evaluation for Magnets in Examples and Comparative Examples

| No. | AGG The number of AGGs | Br (kGs) | Hcj (kOe) | SQ (%) | (BH)max (MGOe) | Attenuation ratio of magnetic flux (%) |
|---|---|---|---|---|---|---|
| Comparative example 1 | 1 | 13.7 | 14.3 | 95.4 | 44.8 | 1.8 |
| Example 1 | 0 | 14.0 | 14.5 | 96.5 | 47.3 | 1.5 |
| Example 2 | 0 | 13.9 | 14.6 | 96.7 | 46.7 | 1.6 |
| Example 3 | 0 | 13.8 | 14.6 | 96.9 | 46.1 | 1.6 |
| Example 4 | 0 | 13.8 | 14.3 | 96.0 | 45.7 | 1.8 |
| Comparative example 2 | 6 | 13.5 | 12.8 | 93.2 | 42.5 | 16.7 |

By detection, in examples 1 to 4, the grain boundary of the rare-earth magnet comprises a W-rich region in which the content of W is greater than or equal to 40 ppm and less than or equal to 3000 ppm, and the W-rich region occupies more than or equal to 50% by volume of the grain boundary.

Throughout the implementation process, the O content in the magnets in the comparative examples and examples was controlled to be less than or equal to 1000 ppm.

It can be seen from the comparative examples and examples that, in a case where the content of Cu is less than 0.1 wt %, the raw material has a high purity and few impurities, and therefore, a few number of AGGs occur.

In a case where the content of Cu is greater than 0.8 wt %, Br of the magnet is reduced, and since Cu is an element with a low melting point, a large number of AGGs may occur.

Similarly, FE-EPMA detection was performed on the sintered magnets in examples 1, 2, 3 and 4. It can be also observed that the W-rich phase precipitates under the pinning effect into the grain boundary, and pins the migration of the grain boundary, thereby preventing AGG from occurring. Ho-rich phase entered into the main phase to form $Ho_2Fe_{14}B$, improving the anisotropic field of the magnets.

Example IV

Preparation process of raw material: Nd with a purity of 99.5%, Ho with a purity of 99.9%, industrial Fe—B, industrial pure Fe, Cu, Al and Zr with purities of 99.5%, and W with a purity of 99.99% were prepared, which were formulated in weight percentage wt %.

The content of each of the elements is shown in Table 8.

TABLE 8

Composition proportion of elements

| No. | Nd | Ho | B | Zr | Cu | Al | W | Fe |
|---|---|---|---|---|---|---|---|---|
| Comparative example 1 | 29 | 3 | 0.95 | 0.1 | 0.1 | 0.05 | 0.005 | Balance |
| Example 1 | 29 | 3 | 0.95 | 0.1 | 0.1 | 0.1 | 0.005 | Balance |
| Example 2 | 29 | 3 | 0.95 | 0.1 | 0.1 | 0.3 | 0.005 | Balance |
| Example 3 | 29 | 3 | 0.95 | 0.1 | 0.1 | 0.5 | 0.005 | Balance |
| Example 4 | 29 | 3 | 0.95 | 0.1 | 0.1 | 0.8 | 0.005 | Balance |
| Comparative example 2 | 29 | 3 | 0.95 | 0.1 | 0.1 | 0.9 | 0.005 | Balance |

For each of the above groups, 10 Kg of a raw material was formulated by weighing the elements respectively according to the element composition in Table 8.

Melting process: Each of the prepared raw materials was put into a crucible made of aluminum oxide, and was subjected to vacuum melting in a vacuum induction melting furnace under a vacuum of $10^{-2}$ Pa at a temperature less than or equal to 1500° C.

Casting process: After the vacuum melting, an Ar gas was introduced into the melting furnace until the pressure reached 60000 Pa, and then casting was performed using a single-roller quenching process at a cooling speed ranging from $10^{2}$° C./s to $10^{4}$° C./s, obtaining a rapidly quenched alloy. The rapidly quenched alloy was subjected to heat treatment for 5 hours at a temperature of 700° C., and then cooled to room temperature.

Hydrogen decrepitation process: A hydrogen decrepitation furnace in which the rapidly quenched alloy was placed was vacuumized at room temperature, and then hydrogen with an purity of 99.5% was introduced into the hydrogen decrepitation furnace to a pressure of 0.1 Mpa. After left for 2 hours, the furnace was vacuumized while raising the temperature, which was vacuumized for 2 hours at a temperature of 540° C., and then was cooled down, obtaining powder after the hydrogen decrepitation.

Fine grinding process: The specimen obtained after the hydrogen decrepitation was subjected to jet milling in a pulverizing chamber at a pressure of 0.5 Mpa in an atmosphere having an oxidizing gas content less than or equal to 100 ppm, obtaining fine powder having an average grain size of 3.7 μm. The oxidizing gas refers to oxygen or moisture.

Methyl caprylate was added into the powder obtained after the jet milling in an amount of 0.15% relative to the weight of the mixed powder, and then was well mixed with the powder by a V-type mixer.

Magnetic field shaping process: The powder in which the methyl caprylate had been added as described above was primarily shaped as a cube having a side length of 25 mm using a right angle-oriented magnetic field shaping machine in an oriented magnetic field of 1.8 T at a shaping pressure of 0.2 ton/cm$^2$, and was demagnetized after the primary shaping. The shaped body was taken out from the space of the magnetic field shaping machine, and another magnetic field was applied onto the shaped body, so as to subject the magnetic powder attaching on the surface of the shaped body to a second demagnetizing process.

In order to prevent the shaped body obtained after the primary shaping from being in contact with air, the shaped body was sealed, and then subjected to a secondary shaping using a secondary shaping machine (isostatic pressure shaping machine).

Sintering process: The shaped body was transferred to a sintering furnace for sintering, which was sintered under a vacuum of $10^{-3}$ Pa at a temperature of 200° C. for 2 hours and at a temperature of 900° C. for 2 hours, and then sintered at a temperature of 1020° C. for 2 hours. Thereafter, Ar gas was introduced into the sintering furnace until the pressure reached 0.1 MPa, and then the sintered body was cooled to room temperature.

Heat treatment process: The sintered body was subjected to heat treatment in a high-purity Ar gas at a temperature of 550° C. for 1 hour, cooled to room temperature and then taken out. Processing process: The sintered body obtained after the heat treatment was processed into a magnet with φ of 15 mm and a thickness of 5 mm, with the direction of the thickness of 5 mm being the orientation direction of the magnetic field.

Evaluation results of the magnets in examples and comparative examples are shown in Table 9.

TABLE 9

Performance Evaluation for Magnets in Embodiments and Comparative Examples

| No. | AGG The number of AGGs | Br (kGs) | Hcj (kOe) | SQ (%) | (BH)max (MGOe) | Attenuation ratio of magnetic flux (%) |
|---|---|---|---|---|---|---|
| Comparative example 1 | 2 | 13.3 | 17.0 | 95.4 | 42.2 | 1.9 |
| Example 1 | 0 | 13.2 | 17.5 | 96.7 | 42.1 | 1.8 |
| Example 2 | 0 | 13.1 | 18.4 | 96.8 | 41.5 | 1.6 |
| Example 3 | 0 | 13.0 | 19.5 | 97.2 | 41.1 | 1.6 |
| Example 4 | 0 | 12.9 | 21.0 | 95.9 | 39.9 | 1.8 |
| Comparative example 2 | 5 | 12.5 | 16.9 | 93.5 | 36.5 | 10.4 |

By detection, in examples 1 to 4, the grain boundary of the rare-earth magnet comprises a W-rich region in which the content of W is greater than or equal to 40 ppm and less than or equal to 3000 ppm, and the W-rich region occupies more than or equal to 50% by volume of the grain boundary.

Throughout the implementation process, the O content in the magnets in the comparative examples and examples was controlled to be less than or equal to 1000 ppm.

It can be seen from the comparative examples and examples that, in a case where the content of Al is less than 0.1 wt %, the raw material has a high purity and few impurities, and therefore, a few number of AGGs occur.

In a case where the content of Al is greater than 0.8 wt %, Br in the magnet is dramatically reduced due to the excess Al, and since Al is an element with a low melting point, a large number of AGGs may occur.

Similarly, FE-EPMA detection was performed on the sintered magnets in examples 1, 2, 3 and 4. It can be also observed that the W-rich phase precipitates under the pinning effect into the grain boundary, and pins the migration of the grain boundary, thereby preventing AGG from occurring. Ho-rich phase entered into the main phase to form $Ho_2Fe_{14}B$, improving the anisotropic field of the magnets.

The examples described above only serve to further illustrate some particular embodiments of the present disclosure, however, the present disclosure is not limited to the examples. Any simple alternations, equivalent changes and modifications made to the examples above according to the technical essence of the present disclosure will fall within the protection scope of the technical solutions of the present disclosure.

Industrial applicability: A Ho and W-containing rare-earth magnet according to the present disclosure mainly consists of a W-rich grain boundary phase and a Ho-rich main phase. The crystal grain growth of the Ho-containing magnet during a sintering process is inhibited by a small amount of W, thereby preventing AGG from occurring in the Ho-containing magnet, and obtaining a magnet with high coercivity and high heat resistance, which has good industrial applicability.

The invention claimed is:

1. A rare-earth magnet comprising a main phase of $R_2Fe_{14}B$, wherein:

the rare-earth magnet comprises the following raw material components:

R: 28 wt % to 33 wt %, where R is a rare-earth element comprising Nd and Ho, and a content of Ho ranging from 0.3 wt % to 5 wt %;

B: 0.8 wt % to 1.3 wt %;

W: 0.0005 wt % to 0.03 wt %; and a balance being T and inevitable impurities, where T mainly comprises Fe and further comprises 0 wt % to 18 wt % of Co, a grain boundary of the rare-earth magnet comprises a W-rich region in which a content of W is greater than or equal to 40 ppm and less than or equal to 3000 ppm, and the W-rich region occupies at least 50% of a volume of the grain boundary.

2. The rare-earth magnet according to claim 1, wherein T comprises at least one element with a content less than or equal to 2.0 wt % selected from Sn, Sb, Hf, Bi, V, Zr, Mo, Zn, Ga, Nb, Ni, Ti, Cr, Si, Mn, S, or P; Cu with a content less than or equal to 0.8 wt %; Al with a content less than 0.8 wt %; and a balance being Fe.

3. The rare-earth magnet according to claim 2, wherein the rare-earth magnet is manufactured by:

preparing an alloy for the rare-earth magnet from a melt of the raw material components of the rare-earth magnet;

performing coarse grinding on the alloy for the rare-earth magnet to manufacture coarse powder;

performing fine grinding on the coarse powder to manufacture fine powder;

subjecting the fine powder to a magnetic field shaping process to obtain a shaped body; and sintering the shaped body in a vacuum or an inert gas to obtain a sintered rare-earth magnet with an oxygen content less than or equal to 1000 ppm.

4. The rare-earth magnet according to claim 3, wherein:

the preparing the alloy comprises cooling the melt of the raw material components at a cooling speed greater than or equal to $10^{2\circ}$ C./s and less than or equal to $10^{4\circ}$ C./s with a strip casting process, the coarse grinding comprises performing hydrogen decrepitation on the alloy for the rare-earth magnet, and the fine grinding comprises performing jet milling on the coarse powder.

5. The rare-earth magnet according to claim 1, wherein the rare-earth magnet is a Nd—Fe—B based sintered magnet.

6. The rare-earth magnet according to claim 5, wherein T comprises Cu with a content ranging from 0.1 wt % to 0.8 wt %.

7. The rare-earth magnet according to claim 5, wherein T comprises Al with a content ranging from 0.1 wt % to 0.8 wt %.

8. The rare-earth magnet according to claim 5, wherein T comprises at least one element selected from Sn, Sb, Hf, Bi, V, Zr, Mo, Zn, Ga, Nb, Ni, Ti, Cr, Si, Mn, S, or P, and a total content of the at least one element ranges from 0.1 wt % to 2.0 wt % of the raw material components of the rare-earth magnet.

9. The rare-earth magnet according to claim 1, wherein the rare-earth magnet comprises at least two phases, wherein the at least two phases are a W-rich grain boundary phase and a Ho-rich major phase, wherein the Ho-rich major phase corresponds to the main phase of $R_2Fe_{14}B$.

10. The rare-earth magnet according to claim 1, wherein the content of W ranges from 0.0005 wt % to 0.01 wt %.

11. The rare-earth magnet according to claim 2, wherein the rare-earth magnet is a Nd—Fe—B based sintered magnet.

12. The rare-earth magnet according to claim 11, wherein T comprises Cu with a content ranging from 0.1 wt % to 0.8 wt %.

13. The rare-earth magnet according to claim 11, wherein T comprises Al with a content ranging from 0.1 wt % to 0.8 wt %.

14. The rare-earth magnet according to claim 11, wherein T comprises at least one element selected from Sn, Sb, Hf, Bi, V, Zr, Mo, Zn, Ga, Nb, Ni, Ti, Cr, Si, Mn, S, or P, and a total content of the at least one element ranges from 0.1 wt % to 2.0 wt % of the raw material components of the rare-earth magnet.

15. The rare-earth magnet according to claim 1, wherein a number of abnormal grain growths in the rare-earth magnet is between 0-2.

16. The rare-earth magnet according to claim 1, wherein a BH(max) of the rare-earth magnet is at least than 45.

17. The rare-earth magnet according to claim 1, wherein an oxygen content of the rare-earth magnet is 1000 ppm or less.

18. The rare-earth magnet according to claim 1, wherein T comprises Cu with a content ranging from 0.1 wt % to 0.8 wt % and Al with a content ranging from 0.1 wt % to 0.8 wt %.

19. The rare-earth magnet according to claim 18, wherein the content of W ranges from 0.0005 wt % to 0.01 wt %.

20. The rare-earth magnet according to claim 1, wherein:

T comprises at least one of Cu with a content ranging from 0.1 wt % to 0.8 wt % or Al with a content ranging from 0.1 wt % to 0.8 wt %, and the content of W ranges from 0.0005 wt % to 0.01 wt %.

* * * * *